United States Patent [19]

Ouchi et al.

[11] 4,256,516

[45] Mar. 17, 1981

[54] METHOD OF MANUFACTURING NON-MAGNETIC FE-MN STEELS HAVING LOW THERMAL EXPANSION COEFFICIENTS AND HIGH YIELD POINTS

[75] Inventors: Chiaki Ouchi; Yohji Kohsaka, both of Yokohama, Japan

[73] Assignee: Nippon Kokan Kabushiki Kaisha, Tokyo, Japan

[21] Appl. No.: 104,754

[22] Filed: Dec. 18, 1979

[30] Foreign Application Priority Data

Dec. 26, 1978 [JP] Japan ..... 53-159206
Jan. 30, 1979 [JP] Japan ..... 54-8770

[51] Int. Cl.[3] ..... C22C 37/00; C22C 39/54; C21D 7/13

[52] U.S. Cl. ..... 148/12 R; 75/123 J; 75/123 K; 75/123 N; 75/128 A; 148/12 E

[58] Field of Search ..... 75/123 N, 123 J, 123 K, 75/128 A; 148/12 R, 12 E

[56] References Cited

U.S. PATENT DOCUMENTS 3,678,571 7/1972 Schoffmann ..... 29/527.6
3,698,889 10/1972 Bungardt et al. ..... 75/123
4,043,838 8/1977 Devrell ..... 148/2

*Primary Examiner*—G. Ozaki
*Assistant Examiner*—Upendra Roy
*Attorney, Agent, or Firm*—Frishauf, Holtz, Goodman & Woodward

[57] ABSTRACT

Low nonmagnetic steel having a thermal expansion coefficient of $1.0\sim1.3\times10^{-5}$/°C. and a high yieldin point of higher than 36 Kg/mm$^2$ consists of less than 0.5% by weight of C, less than 2% by weight of Si, 20~30% by weight of Mn, and 0.005~0.04% by weight of N and the balance of iron and impurities. wherein the following relationships between the amounts of C and Mn are simultaneously satisfied.

$Mn(\%)>16\times C(\%)+18$ $Mn(\%)>-12\times C(\%)+21.5$

The steel described above is heated to a temperature of less than 1220° C., and then hot rolled. A finishing rolling temperature is maintained to be less than 800° C.+400° C.×C(%) depending upon the amount of carbon. After cold working the nonmagnetic steel has a permeability of less than 1.1.

2 Claims, 10 Drawing Figures

METHOD OF MANUFACTURING NON-MAGNETIC FE-MN STEELS HAVING LOW THERMAL EXPANSION COEFFICIENTS AND HIGH YIELD POINTS

BACKGROUND OF THE INVENTION

This invention relates to nonmagnetic steel having a low thermal expansion coefficient and a high yielding point and a method of manufacturing the same.

The field of application of nonmagnetic steel has been broadened in recent years, for example as structural materials for constructing magnetic floating type high speed railway (so-called a linear motor car), atomic reactors, various electric component parts or the like. Suitable nonmagnetic steel can be obtained by selecting its composition to have austenitic structure. Typical example of such a steel is austenitic stainless steel. In addition, Hadfield steel (containing 0.9~1.3% by weight of C and 11~14% by weight of Mn) is a famous one. In the following description, all percentages of the elements are % by weight based on the total weight of the nonmagnetic steel. As improvements thereof, such low carbon, high manganese nonmagnetic steels are known as Mn-Cr steel (for example DIN×40 Mn-Cr 18 steel), Mn-Cr-Ni steel (for example DIN×5 Mn Ni Cr 14 steel), and Mn-Cr-Ni-V steel (for example DIN×45 Mn Ni Cr V 1376 steel), etc.

The linear motor cars are prosperious in future and such railway system requires a large quantity of nonmagnetic steel as guideway structures or reinforcing steels for manufacturing railway beds so that addition of such expensive alloying elements as Ni and V is not advantageous. Such nonmagnetic steel is also required to have low thermal expansion coefficient and low electric resistivity in addition to nonmagnetic property. Moreover it is also required that the permeability should not increase even after cold working eg. However, the prior art nonmagnetic steel can not satisify these requirements.

SUMMARY OF THE INVENTION

Accordingly, it is the principle object of this invention to provide low cost nonmagnetic steel having a low thermal expansion coefficient comparable with that of ferritic steel or lower, a high yielding point and a low permeability which would not increase after machining and method of manufacturing such nonmagnetic steel.

Another object of this invention is to provide a novel method of manufacturing nonmagnetic steel at a low cost having a low thermal expansion coefficient comparable with that of ordinary steel (mean thermal expansion coefficient of $1.0\sim1.3\times10^{-5}$/°C. at a temperature of 0°~100° C.), a high yielding point (0.2% proof stress) of higher than 36 Kg/mm$^2$ and a permeability of less than 1.1% after cold working.

Accordingly, the nonmagnetic steel is suitable for use as guide structures and reinforcing steels of railroad beds of the floating type high speed railway, structural members for constructing fusion reactors, various electrical components, etc.

According to one aspect of this invention there is provided nonmagnetic steel having a low thermal expansion coefficient, characterized by consisting of less than 0.5% by weight of C, less than 2% by weight of Si, 20~30% by weight of Mn, and 0.005~0.04% by weight of N and the balance of iron and impurities, wherein the following relationships between the amounts of C and Mn are simultaneously satisfied.

$Mn(\%)>16\times C(\%)+18$ $Mn(\%)>-12\times C(\%)+21.5$

According to another aspect of this invention there is provided a method of manufacturing nonmagnetic steel having a low thermal expansion coefficient and a high yielding point, characterized by comprising the steps of:

preparing slab or ingot containing 0.5% by weight of carbon, less than 2% by weight of silicon, 20~30% by weight of manganese, 0.005~0.04% by weight of nitrogen and the balance of iron and impurities, in which the following relationships are simultaneously satisfied $$Mn(\%)>16\times C(\%)+18 \quad (1)$$

$$Mn(\%)>-12\times C(\%)+21.5 \quad (2)$$

heating said slab or ingot to a temperature of less than 1220° C.;

hot rolling the heated slab or ingot; and maintaining a finishing temperature to be less than 800° C.+400° C.×C (%) depending upon the amount of carbon.

The nonmagnetic steel of this invention may further contain less than 2% by weight of Cr.

DESCRIPTION OF THE PREFERRED EMBODIMENTS

The reason for limiting the ranges of the elements are as follows.

More particularly C is an important element for stabilizing austenite and as the amount of C increases the amount of another austenite stabilizing elements can be reduced. Moreover, C is effective to increase the strength of austenitic steel. For example, the yielding strength increases 1.8 Kg/mm$^2$ while the tensile strength increases 2.2 Kg/mm$^2$ per 0.1% of C. For this reason, it is necessary to use C in an amount in excess of a predetermined value in order to obtain the yield strength of larger than 20 Kg/mm$^2$. Too much C, however, degrades hot workability and/or requires to increase the amount of Mn for the purpose of obtaining desired thermal expansion coefficient. This not only uneconomical but also impairs cutting machinability.

Figure 1:
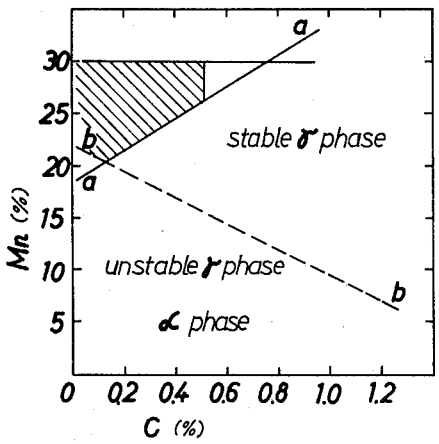
FIG. 1 is a graph showing a relationship between the amounts of carbon and manganese of the present invention.

Mn is cheeper element than another austenite stabilizing elements so that the austenite stability of high Mn steel is mainly determined by a balance between the amounts of C and Mn. In other words, as the amount of C increases, austenite can be stabilized with lesser amount of Mn. In high carbon steel the lower limit of Mn is about 7% but it is necessary to increase the amount of Mn to at least 20% in order to maintain low thermal expansion coefficient as will be desired later. Incorporation of Mn in excess of 30% increases the cost of manufacturing and complicates the manufacturing steps. For this reason the upper limit of Mn was determined to be 30%. The result of regression analysis regarding the thermal expansion coefficient of 30 types of steel shows that C has a tendency of increasing thermal expansion coefficient whereas Mn has a tendency of decreasing the same. The ranges of C and Mn that result in a thermal expansion coefficient comparable with that of ordinary steel, that is less than $1.25\times10^{-5}$/°C. (average of from 0° to 100° C.) are expressed by equation (1) and shown by the region above a line a—a in FIG. 1.

As above described both C and Mn act as austenite stabilizing elements and increase in the amounts of these elements decreases permeability. The ranges of C and Mn which can produce stable nonmagnetic steel after 20% cold reduction were determined by degression analysis and are shown as a region above a line b—b shown in FIG. 1. This relationship is expressed by equation (2).

Thus, in order to have a thermal expansion coefficient of less than $1.25\times10^{-5}$/°C. which is nearly equal to that of ordinary steel and a permeability of less than 1.1 after cold working, it is necessary to limit the amount of Mn as above described and to simultaneously satisfy equations (1) and (2).

Figure 2:
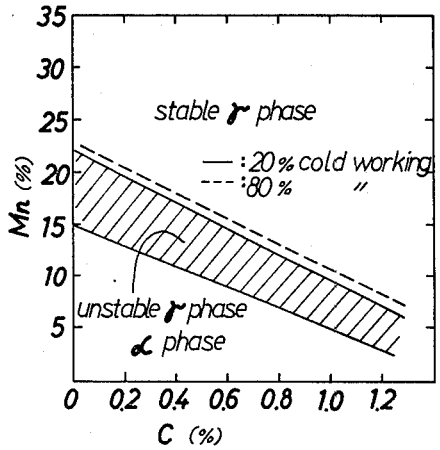
FIG. 2 is a graph showing a relationship between the amounts of carbon and manganese necessary to obtain a stable austenitic phase.

The balance relationship between the amounts of C and Mn which are necessary to obtain stabilized austenite phase after 20% cold working or 80% cold working is shown in FIG. 2 which shows that the balance relationship is nearly equal for 20% and 80% cold workings.

The Hadfield steel or its improved low carbon high manganese steel, which are typical of the prior art nonmagnetic steels have a thermal expansion coefficient of from 1.5 to $1.8\times10^{-5}$/°C.

Less than 0.005% of N tends to lose the austenite stability whereas more than 0.04% of N impairs the hot workability of steel. For this reason, the range of N was selected to be 0.005 to 0.04%.

While Ni, Cr and V are elements effective to increase the strength of austenitic steel, from the standpoint of economy, it is advantageous to select Ni to be less than 2%, Cr to be less than 2% and V to be less than 0.5%. Incorporation of these elements within these ranges does not impair extremely the thermal expansion coefficient, one of the features of this invention.

Some examples of the nonmagnetic steel of this invention will now be described as follows.

Table I below shows the mechanical and physical properties of hot rolled steels embodying the invention and comparative steels. Each sample were prepared from a 25 Kg steel ingot which was then hot rolled.

TABLE I

| | C | Si | Mn | sol Al | Total N | 0.2% PS Kg/mm$^2$ | TS Kg/mm$^2$ | El % | thermal expansion coefficient $\times10^{-5}$/°C. | electric resistivity $\mu\Omega$cm | permeability as rolled $\mu$ | permeability 20% cold worked | | remark |
|---|---|---|---|---|---|---|---|---|---|---|---|---|---|---|
| A | 0.12 | 0.33 | 27.4 | 0.036 | 0.0085 | 21.7 | 65.3 | 63.3 | 0.95 | 71.6 | 1.001 | 1.001 | this invention | |
| B | 0.24 | 0.34 | 14.5 | 0.034 | 0.0116 | 21.8 | 76.7 | 10.9 | 1.52 | 61.4 | 1.416 | 3.794 | control | |
| C | 0.27 | 0.30 | 24.9 | 0.025 | 0.0353 | 26.0 | 76.8 | 70.5 | 1.07 | 70.3 | 1.002 | 1.002 | this invention | |
| D | 0.50 | 0.32 | 17.6 | 0.025 | 0.0271 | 32.3 | 98.6 | 73.6 | 1.53 | 62.6 | 1.002 | 1.034 | control | |
| E | 0.42 | 0.32 | 26.3 | 0.028 | 0.0221 | 28.9 | 82.8 | 79.3 | 1.11 | 72.2 | 1.002 | 1.002 | this invention | |
| F | 0.84 | 0.37 | 10.5 | 0.043 | 0.0133 | 33.2 | 75.0 | 41.0 | 1.78 | 63.8 | 1.003 | 1.084 | control | |
| G | 0.28 | 0.33 | 27.3 | 0.018 | 0.0360 | 27.8 | 71.2 | 75.2 | 0.98 | 73.3 | 1.002 | 1.003 | this invention | Cr:1.7% |
| H | 0.49 | 0.31 | 21.4 | 0.026 | 0.0256 | 30.9 | 93.7 | 78.3 | 1.34 | 67.3 | 1.002 | 1.002 | control | |

Figure 3:
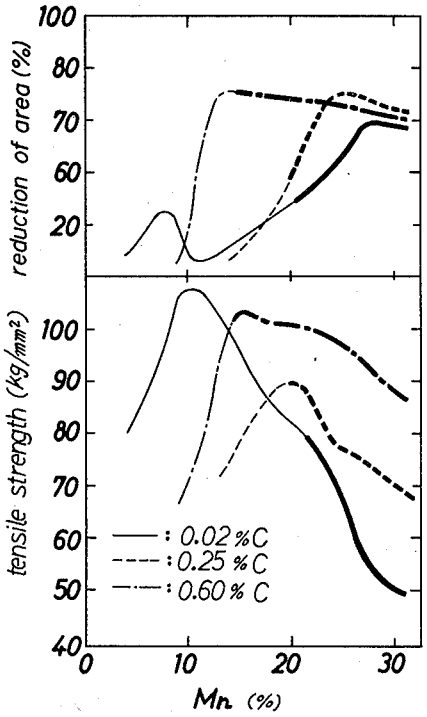
FIG. 3 is a graph showing the relationship between the amount of manganese and the mechanical properties of high manganese steels.

FIG. 3 is a graph showing the relationship between the amount of Mn and the elongation and the tensile strength of steels respectively containing 0.02%, 0.25% and 0.54% of carbon. Thick lines of the graph show stable austenitic phase. As shown by curves shown in the lower portion of FIG. 3, the tensile strength increases with the amount of carbon whereas the austenite phase becomes more stable with the increase in the amount of Mn and the tensile strength decreases.

Figure 4:
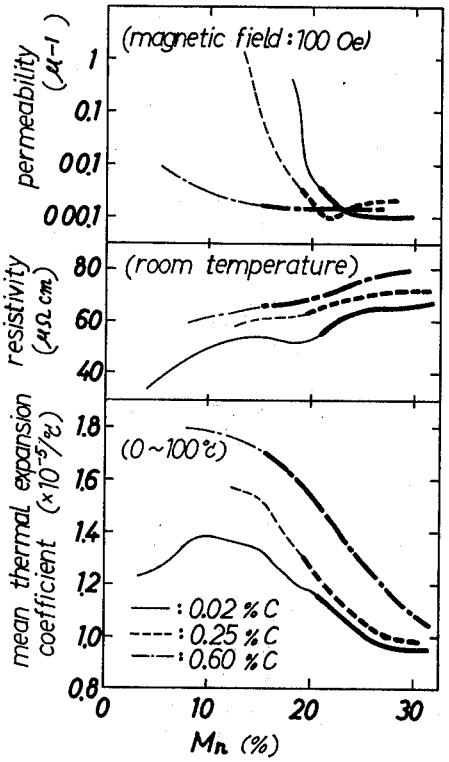
FIG. 4 is a graph showing the relationship between the amount of manganese and the physical properties of high manganese steels.

FIG. 4 shows physical characteristics of the steels containing indicated amounts of carbon. Thus, the mean thermal expansion coefficient decreases with the amount of carbon, but increases with the amount of Mn. The result of regression analysis shows that, in a composition containing a stable austenite phase there is the following relationship between the thermal expansion coefficient $\alpha$ and the amounts of C and Mn.

$$\alpha=1.80+0.48C-0.03Mn \quad (3)$$

Figure 5:
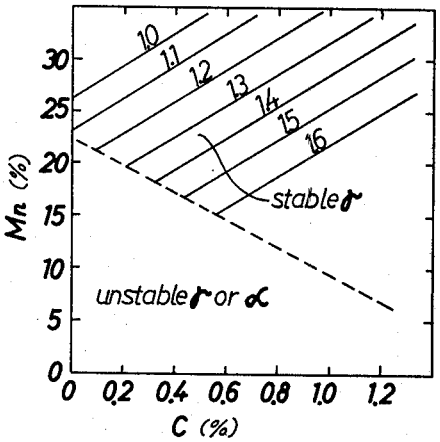
FIG. 5 is a graph showing an equithermal expansion coefficient in a stable austenitic phase.

Equithermal expansion coefficient calculated by equation (3) is shown in FIG. 5. Numerals shown in FIG. 5 represent the mean thermal expansion coefficient $\times10^{-5}$/°C. between 0° C. and 100° C.

As shown by the middle portion of FIG. 4 the resistivity is large and increases with the amounts of C and Mn. Since, the resistivity is generally large in austenite steels, such increase in resistivity does not cause any serious problem.

As shown in the upper portion of FIG. 4 the permeability becomes low regardless of the amounts of C and Mn so long as the steel has a stable austenitic structure, which is an advantageous property for nonmagnetic steel. Sample G shown in Table I contains 1.7% of Cr. But this sample also has a low thermal expansion coefficient of $0.98\times10^{-5}$/°C. as well as sufficiently low resistivity and permeability that can accomplish the object of this invention. Steels incorporated with Ni or V were also investigated and it was found that steel containing less than 2% of Ni or less than 0.5% of V also has a low thermal expansion coefficient which can accomplish the object of this invention.

Figure 6:
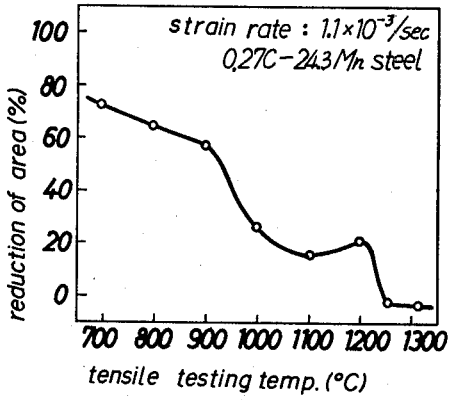
FIG. 6 is a graph showing the relationship between the tensile testing temperature and proof stress at a given strain rate.

To prepare the nonmagnetic steel of this invention care should be taken for the soaking or reheating temperature when hot rolling an ingot or bloom having a composition described above. Thus, FIG. 6 shows the relationship between the tensile testing temperature and high temperature reduction of area when a high Mn austenitic steel is heated and then subjected to a high temperature tensile test. As can be noted from FIG. 6, at temperatures above 1250° C. the reduction of area decreases greatly which results in cracks at high temperatures. In a large steel ingot since segregation of the components is remarkable, it is advantageous to heat it at a temperature below 1220° C.

The rolling condition has a greatly influence upon the yielding strength (0.2% proof stress) of high Mn austenitic steel. More particularly when the austenitic steel is rolled in a low temperature range the grain size of the product can be greatly reduced.

Figure 7:
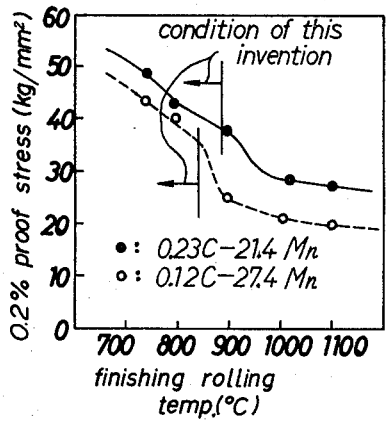
FIG. 7 is a graph showing two examples of the relationship between the finishing rolling temperature and the yielding strength (0.2% proof stress)

FIG. 7 shows the relationship between the finishing rolling temperature and the yielding strength (0.2% proof stress). Thus it is possible to increase the yielding strength by more than 10 Kg/mm$^2$ for controlling the finishing temperature to be below 900° C. for 0.23C–21.4Mn steel and to be less than 850° C. for 0.12C–27.4Mn steel.

Figure 8:
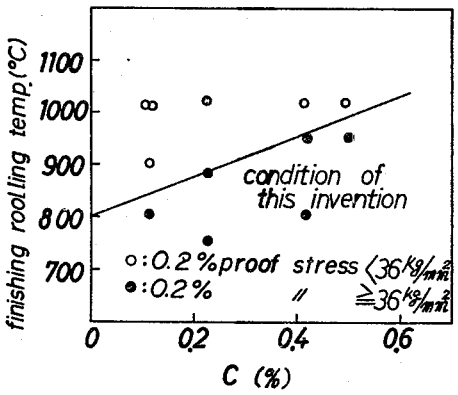
FIG. 8 is a graph showing the relationship between the amount of carbon and the finishing rolling temperature for obtaining 0.2% proof stress.

We have made a number of experiments regarding the amount of carbon and the finishing rolling temperature . The result is shown in FIG. 8 from which it can be noted that in order to obtain a yielding strength of larger than 36 Kg/mm$^2$, the strengthening action caused by carbon should be taken into consideration.

Generally speaking, the finishing temperature should be controlled in a range of from 800° to 950° C. and the finishing rolling temperature should be selected to satisfy the following equation (4).

$$\text{Finishing temp. } FT(°C.) < 800 + 400 \times C(\%) \quad (4)$$

Some preferred examples of the method of this invention will now be described together with control examples. 25 Kg steel ingots each having a composition as shown in the following Table II were rolled under rolling conditions also shown in Table II.

TABLE II

| | C | Si | Mn | Cr | sol. Al | Total N | rolling condition | Type | Sample Number |
|---|---|---|---|---|---|---|---|---|---|
| I | 0.12 | 0.33 | 27.4 | tr | 0.036 | 0.0085 | heated to 1250° C., finished at 1010° C. | control | I1 |
| | | | | | | | heated to 1220° C., finished at 1010° C. | control | I2 |
| | | | | | | | heated to 1200° C., finished at 900° C. | control | I3 |
| | | | | | | | heated to 1200° C., finished at 800° C. | this invention | I4 |
| J | 0.23 | 0.02 | 24.1 | tr | 0.024 | 0.0113 | heated to 1250° C., finished at 1020° C. | control | J1 |
| | | | | | | | heated to 1200° C., finished at 880° C. | this invention | J2 |
| | | | | | | | heated to 1200° C., finished at 750° C. | this invention | J3 |
| K | 0.50 | 0.32 | 17.6 | tr | 0.025 | 0.0271 | heated to 1200° C., finished at 1020° C. | control | K1 |
| | | | | | | | heated to 1200° C., finished at 950° C. | this invention | K2 |
| L | 0.42 | 0.32 | 26.3 | tr | 0.028 | 0.0221 | heated to 1200° C., finished at 1020° C. | control | L1 |
| | | | | | | | heated to 1200° C., finished at 800° C. | this invention | L2 |
| | | | | | | | heated to 1200° C., finished at 950° C. | this invention | L3 |

The measured characteristics of the steel samples shown in this table are shown in the following table III.

TABLE III

| Type | sample number | 0.2 PS Kg/mm$^2$ | TS Kg/mm$^2$ | El % | thermal expansion coefficient $\times10^{-5}$/°C. | permeability as rolled $\mu$ | permeability after cold working 20%, $\mu$ | surface defects |
|---|---|---|---|---|---|---|---|---|
| control | I1 | 20.6 | 64.2 | 65.2 | 0.96 | 1.001 | 1.002 | noted |
| control | I2 | 21.7 | 65.3 | 63.3 | 0.95 | 1.001 | 1.001 | none |
| control | I3 | 25.8 | 68.1 | 62.9 | 0.95 | 1.001 | 1.002 | none |
| this invention | I4 | 40.1 | 75.5 | 61.1 | 0.95 | 1.001 | 1.001 | none |
| control | J1 | 28.8 | 73.6 | 70.2 | 1.07 | 1.002 | 1.002 | noted |
| this invention | J2 | 37.8 | 84.7 | 55.0 | 1.07 | 1.002 | 1.002 | none |
| this invention | J3 | 48.7 | 88.3 | 48.5 | 1.08 | 1.002 | 1.002 | none |
| control | K1 | 32.3 | 98.6 | 73.6 | 1.53 | 1.002 | 1.034 | none |
| this invention | K2 | 39.6 | 99.2 | 69.3 | 1.56 | 1.002 | 1.030 | none |

TABLE III-continued

| Type | sample number | 0.2 PS Kg/mm² | TS Kg/mm² | El % | thermal expansion coefficient $\times 10^{-5}$/°C. | permeability as rolled $\mu$ | permeability after cold working 20%, $\mu$ | surface defects |
|---|---|---|---|---|---|---|---|---|
| control | L1 | 28.9 | 82.8 | 79.3 | 1.11 | 1.002 | 1.002 | none |
| this invention | L2 | 45.2 | 87.1 | 58.3 | 1.09 | 1.002 | 1.002 | none |
| this invention | L3 | 37.2 | 85.1 | 72.2 | 1.11 | 1.002 | 1.002 | none |

As the steels of group I show, when the heating temperature is elevated beyond 1220° C., surface defects are formed, but as the groups I through L show, when the heating temperature is lowered below 1220° C. no surface defect appears on the surface which has been one of the problems in the method of manufacturing high Mn steel plates. Lowering of the finishing rolling temperatures results in an excellent yielding strength and in sample L3 a satisfactory yielding strength was obtained meaning a great saving of expensive alloying elements. The rolling conditions were selected such that the cumulative reduction rate at a temperature below 1000° C. increases continuously as the finishing temperature is decreased. For example, the rolling conditions were selected such that a 60% reduction can be obtained at a finishing temperature of 750° C. Regression analysis showed that the mean thermal expansion coefficient $\alpha$ between 0° and 100° C. can be shown by the equation (3).

Figure 9:
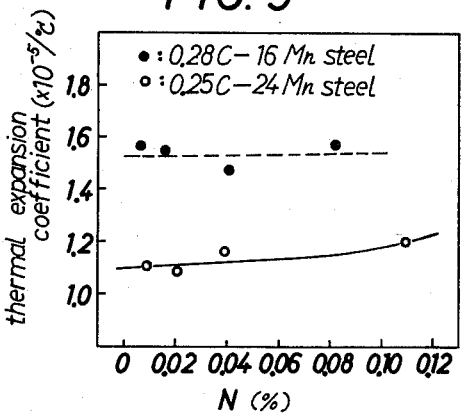
FIG. 9 is a graph showing the relationship between the thermal expansion coefficient of high manganese steel and the amount of nitrogen.
Figure 10:
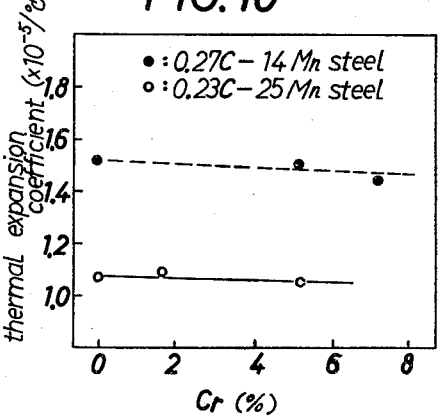
FIG. 10 is a graph showing the relationship between the thermal expansion coefficient and the amount of chromium of a high manganese steel.

The equithermal expansion coefficient calculated according to this equation has already been shown in FIG. 5. The thermal expansion coefficient is not appreciably affected by the amounts of Cr and N as shown in FIGS. 9 and 10. The thermal expansion coefficients of high N and high Mn steels are mainly determined by the amounts of C and Mn thus proving that application of equation (3) is possible.

As above described, the invention provides improved nonmagnetic steel having a low thermal expansion coefficient comparable with or lower than that of ferritic steel and a permeability which is sufficiently low in an as rolled state and does not rise even after cold working. Moreover, it is possible to obtain inexpensive nonmagnetic steel without the necessity of incorporating a large amount of such expensive alloying elements as Ni and V. Consequently, the nonmagnetic steel of this invention is suitable for use as guideway structures and reinforcing steels of railway beds of magnetically floating type high speed railways, nuclear power plants and various electric component parts.

Moreover according to the method of this invention, it is possible to prevent surface defects which have been inevitable in the manufacture of high Mn steel. The method of this invention is applicable to manufacture thick plates, shaped steel stocks or steel bars and rods.

What is claimed is:

1. A method of manufacturing non-magnetic steel having a low thermal expansion coefficient and a high yield point comprising the steps of:

preparing a slab or ingot containing less than 0.5% by weight of carbon, less than 2% by weight of silicon, 20–30% by weight of manganese, 0.005–0.04% by weight of nitrogen and the balance of iron and impurities, in which the following relationships are simultaneously satisfied $$Mn(\%) > 16 \times C(\%) + 18 \quad (1)$$

$$Mn(\%) > -12 \times C(\%) + 21.5 \quad (2)$$

heating said slab or ingot to a temperature of less than 1220° C.

hot rolling the slab or ingot, and finishing rolling at a temperature less than 800° C. + 400° C. × C(%).

2. The method of claim 1, wherein said slab or ingot also contains at least one metal selected from the group consisting of nickel in an amount less than 2% by weight, chromium in an amount less than 2% by weight, and vanadium in an amount less than 0.5% by weight.

* * * * *